US005191937A

United States Patent [19]

Cook, Sr.

[11] Patent Number: 5,191,937

[45] Date of Patent: Mar. 9, 1993

[54] OFFSHORE WELL REMOTE CONTROL SYSTEM

[75] Inventor: Fred R. Cook, Sr., Pearl River, La.

[73] Assignee: Texaco Inc., White Plains, N.Y.

[21] Appl. No.: 659,781

[22] Filed: Feb. 22, 1991

[51] Int. Cl.[5] ..... E21B 34/04

[52] U.S. Cl. ..... 166/363; 166/53; 137/624.18; 341/176

[58] Field of Search ..... 166/53, 285, 321, 323, 166/382, 363; 137/624.18; 74/128; 251/68

[56] References Cited

U.S. PATENT DOCUMENTS

| | | | |
|---|---|---|---|
| 3,863,714 | 2/1975 | Watson, Jr. | 166/53 |
| 4,062,379 | 12/1977 | Clinton | 166/53 |
| 4,215,746 | 8/1980 | Hallden et al. | 166/53 |
| 4,805,657 | 2/1989 | Carman et al. | 251/68 |

*Primary Examiner*—Ramon S. Britts
*Assistant Examiner*—Frank S. Tsay

[57] ABSTRACT

In a subterranean well for producing a production fluid flow through a flow line having a main control valve, a flow control system including means to remotely actuate the main flow valve to open position in response to a radio signal subsequent to the main valve being closed under elective or emergency conditions. Initial fluid flow from the well is commenced by provisionally opening the main flow regulating valve for a predetermined time interval. During said timed interval, if the pressure in the well flow line is not stabilized to an acceptable operating range, the main flow valve will be automatically closed in response to a pressure sensing means which communicates said main flow line with the main valve actuator.

11 Claims, 2 Drawing Sheets

OFFSHORE WELL REMOTE CONTROL SYSTEM

During the production of hydrocarbons such as crude oil or natural gas, from a subterranean reservoir, it is necessary to closely regulate and control the flow of the well effluent, the latter normally being comprised of crude oil, water and gas. Close regulation of the well's operation is essential not only to preserve the flow of product, but to do so in a manner to assure that the environment is protected and that the operation does not constitute a prospective safety hazard.

Some offshore wells, when they reach the producing stage, are operated and controlled remotely. Such wells are provided with the necessary control equipment in the form of valving, pressure regulators and the like to maintain a controlled orderly outflow of product. The system, in one embodiment, includes the use of radio transmission between the well and a land based control center. Each well can thereby be individually monitored and controlled as needed, either by an operator or automatically.

It can be appreciated that a reliable remote control feature is highly desirable in any offshore well, particularly where a malfunction at the well or the well head can result in spillage of crude oil into the surrounding waters. Also, when weather conditions are such that well equipment might be damaged as by a hurricane or the like, it is frequently desirable to close the well in and allow it to remain idle until the weather crisis has subsided.

Toward promoting well safety, the U.S. Federal Government (Minerals Management Office) has established procedures for recommencing flow, or opening a well to restore production after the well has been closed down under normal or an emergency situation. The mandated well starting procedures take into account that control or other equipment may have been damaged to the point where permitting the well to flow could constitute a safety hazard to the environment, to equipment and personnel or to all three.

With these concerns in mind the Federal regulation presently in effect requires that when a well is to be opened to allow flow to recommence, the presence of an operator on the well site is necessary to physically restart fluid flow. This regulation assumes that usually by opening the main flow valve the operator has checked the well equipment to assure that it is in proper condition to assure the safe continuation of the producing operation.

It can be appreciated that for a large number of individual offshore wells, each of which is remotely regulated, restarting by manual adjustment at the well site can be a hazardous, time consuming and expensive phase of the producing operation. To obviate the need for personnel at the well site, the present system provides a means for remotely reopening a well after a shut down. It further incorporates a safety feature that automatically closes down the well should it be found to be operating in a manner to cause the well's flow line pressure to stabilize either below or above a predetermined desirable range of flow line operating pressures.

STATEMENT OF THE INVENTION

To remotely reopen or to recommence flow from an offshore well in a safe manner, the well is presumed to be provided with a main flow line having a flow line valve which is subject to actuation whereby production flow through the valve and the flow line is controlled. The control system embodies means for remotely actuating the main flow control valve to open position to institute a provisional flow of production fluid. The system further embodies a timer mechanism which is preset to an interval of about two minutes or fraction thereof. During this time interval, flow line pressure will presumably stabilize to a value within a prescribed range of operating pressures.

If, at the end of the timed interval, the flow line pressure fails to stabilize at an acceptable value within the prescribed operating range, a safety mechanism will discontinue further production flow from the well by closing the main flow control valve.

To achieve the objectives of the invention, the novel method includes providing a remotely actuated control system that comprises basically two pneumatic circuits. Both of said circuits are concurrently functional to selectively communicate the main flow valve actuator, to the flow line.

The first pneumatic circuit includes a pressure sensing means communicated with the flow line. Said pressure sensing means functions to assure production fluid flow from the well only within a prescribed range of flow line pressures. The pressure sensing means is communicated with the main valve actuator to discontinue production flow through said main valve in the event the flow line pressure does not stabilize to a value within the prescribed operating range.

The second hydraulic circuit includes a flow initiating valve which is actuated to open position by a remotely transmitted radio signal. Timer means associated with said flow initiating valve maintains communication between the flow line and the main valve actuator. After a preset operating period, the timer automatically disconnects said second circuit whereby releasing the main valve actuator, to allow said main valve to close only in the event the pressure sensing means indicates a flow line pressure outside of the prescribed operating pressure range.

It is therefore an object of the invention to provide a well control system that is capable of assuring safe startup or reopening of a closed down well through the facility of a remotely transmitted signal.

DESCRIPTION OF THE DRAWINGS

FIG. 1 represents an embodiment of an offshore well 10 positioned such that a casing 11 is embedded into the ocean floor 12. Casing il extends through the body of water 13 to a point above the surface 14. Above the latter, the well is comprised of a support platform 16 having a well head 17 which includes necessary flow control valving and pressure regulating members. Casing 11 supports platform 16 as well as well head 17 which maintains control over the production flow.

Figure 1:
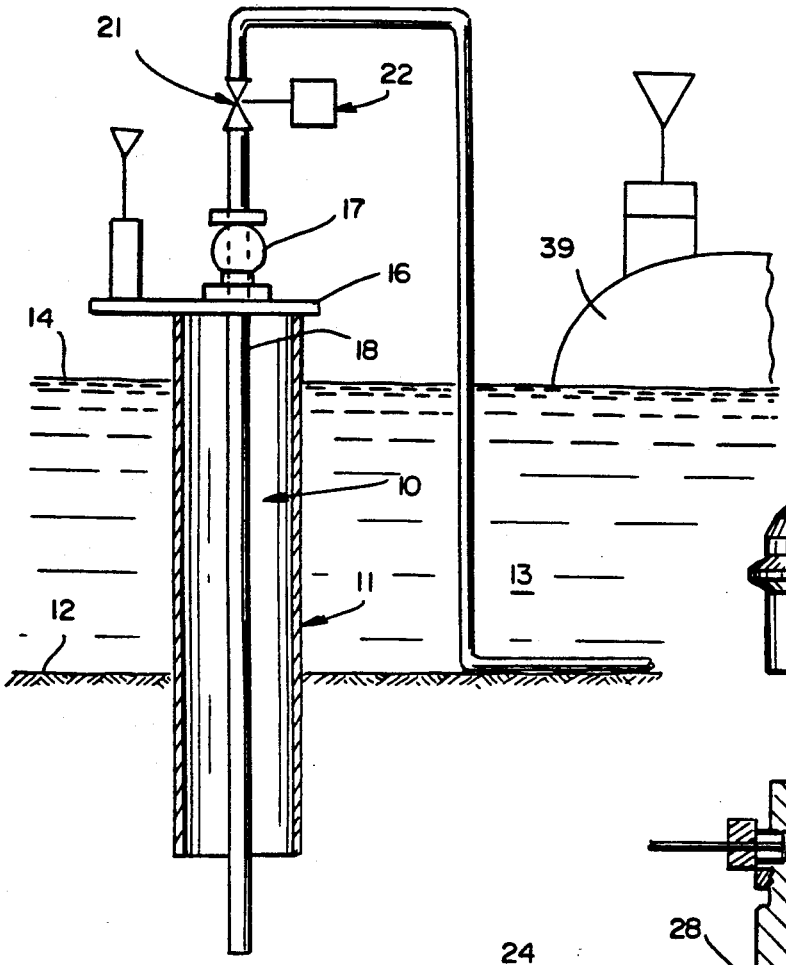
FIG. 1 is an environmental illustration of a well of the type contemplated.

In the standard form of well head, the necessary valving is provided which will direct produced fluid flow from the oil containing reservoir, to a vessel positioned nearby or to a shore position. Preferably, production from a number of satellite wells is accumulated for further processing or pipelining to a processing point.

Well head 17 is communicated with a flow line 18 which extends downwardly through casing 11 and into the reservoir. Flow line 18 is perforated in the usual manner to allow ingress of production fluids from the surrounding substrate, and is further provided with a main flow control valve 21. Said valve is incorporated into flow line 18 and functions between opened and closed positions as dictated by a main valve actuator 22.

It should be noted that the disclosed control system is comprised in general of an electro-pneumatic combination in which the well's gas products function as the flow or pneumatic medium.

The upper end of well 10 as noted embodies a normal form of well head 17 having operating components, some of which may function in response to a radio signal or pulse which is received from a transmitter station 38 normally a distance away which can be many miles from the well.

The shore based control or transmitting segment 38 is comprised primarily of a transmitter or transceiver capable of broadcasting a predetermined frequency controlled signal a sufficient distance to reach the well being regulated.

Figure 2:
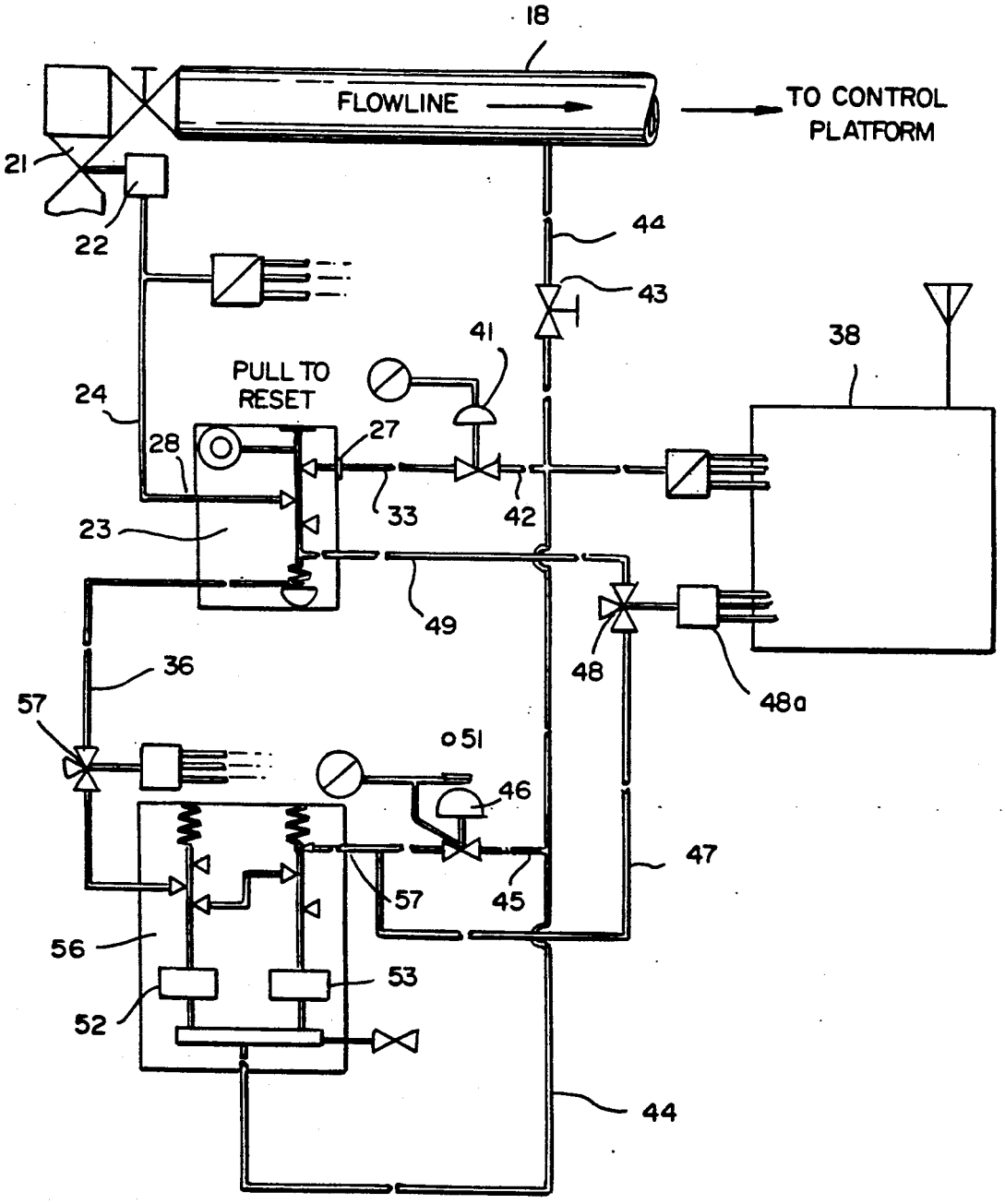
FIG. 2 is a schematic illustrating the well's control system.

Referring to FIG. 2, at well 10, the control system is comprised of first or main control valve 21 which, as noted, is positioned to regulate all fluid flow from the subterranean reservoir to well head 17 through flow line 18. Valve 21 is set to fully open or closed positions, being subject to adjustment by main valve actuator 22 to which it is operably connected.

Figure 3:
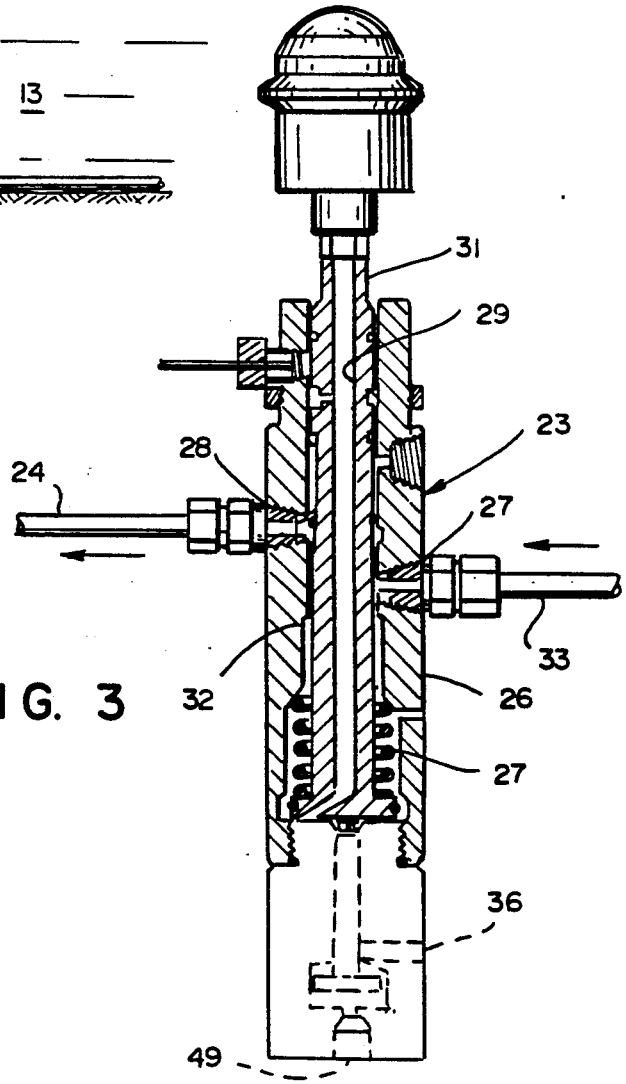
FIG. 3 is an enlarged segmentary section of element 23 in FIG. 2.

Referring to FIGS. 2 and 3, actuator 22 is communicated to a second valve 23 by line 24 through which gas, as the actuating medium, is conducted. Second valve 23 in one embodiment is comprised of a generally elongated body 26 having an inlet port 27 and an outlet port 28. An axial flow passage 29 through the elongated body, defines a cylindrical guide for a transfer plunger or member 31.

Plunger 31 comprises a piston-like member for sliding longitudinal movement between advanced and retracted positions. Plunger 31 further includes spaced apart peripheral seals which slidably engage the cylinder guide walls to form a dynamic fluid tight engagement. An annular chamber 32 formed in the periphery of plunger 31 between the spaced apart seals communicates inlet and outlet ports 27 and 28 when the plunger is withdrawn to the retracted position thereby allowing pressurized fluid to pass from line 33 into line 24 and thence to main valve actuator 22.

One end of the valve body 26 is provided with an inlet port 36 for receiving pressurized fluid to urge plunger 31 to its retracted position. A spring 37 retained within valve body 26, urges plunger 31 into its advanced position to discontinue flow through annular compartment 32 and thus discontinue activating pressure on main valve actuator 22 thereby permitting main valve 21 to close.

Valve 23 is of the type manufactured by BWB Controls, Inc., identified as EHBI Relay.

Line 33 is provided with a pressure regulator 41 which is communicated by line 42 to flow line 18, through a connecting valve 43. Functionally, when connecting valve 43 is in open position, flow line 18 will be communicated directly by way of pressure regulator 41 to second valve 23. Pressure regulator 41 functions to limit flow line pressure acting valve 23 to a preferred operating strength of about 120 psi or less.

Actuation of the second valve plunger 31 to open the main flow valve 21, is achieved by way of line 44 which communicates flow line 18 to a second pressure regulator 46 at line 45. Pressure is then communicated by line 47 to a third or reset solenoid valve 48. The latter is comprised of a remotely actuated member which is normally in the valve closed position to prohibit fluid flow therethrough to second valve 23.

To allow for provisional operation of the well during a brief time interval until the pressure in the flow line 18 stabilizes, a third, or solenoid reset valve 48 is provided with a timer mechanism 48*a* which can be preset to register a brief time interval from 2 minutes to a fraction thereof, down to about 10 seconds.

During this brief timed period, third valve 48 is maintained in the open position to allow passage of actuating gas from low pressure regulator 46 by way of said valver 48 and line 49, to inlet 58 at second valve body 26. Pressure in line 36 is maintained sufficiently high to hold plunger 31 in its retracted position against pressure exerted by spring 37 when flow through said line 49 is discontinued by closure of third valve 48 at the end of the timed interval. When the pressure in flow line 18 fails, pressure sense device 56 vents line 36 to atmosphere, and plunger 31 will automatically be forced into the advanced position by spring 37 pressure, thereby discontinuing flow to main valve actuator 22.

This safety feature of allowing for a provisional operation of the well to permit fluid flow to stabilize, constitutes a major advance in the well startup procedure. More particularly the feature has the capability of automatically shutting down well flow completely, or closing off the main flow valve 21, in the eventuality that pressure stabilization in flow line 18 has not occurred prior to termination of the preset time interval.

Upon the closing of the third valve 48 to discontinue fluid flow therethrough, movement of the valve plunger 31 will concurrently relieve pressure in line 24 by venting the same.

While the well is functioning normally in the producing mode, it will be subjected to maintaining the desired pressure range in flow line 18. This is achieved by way of a high/low pressure sensor apparatus 56. This member functions to discontinue well operation by closing of the main flow valve 21 at such time as the condition in flow line 18 exceeds either the high or low limits of the preferred operating pressure range. Thus, said pressure monitoring apparatus 56 includes a plurality of sensing members 52 and 53, each of which is communicated with flow line 18 to detect or monitor pressure therein on a constant basis.

At such time as the flow range pressure exceeds the preferred operating range in either an upward or downward direction, fluid flow from regulator 46 by way of line 57 into the pressure sensing device 56, will discontinue flow through downstream line 36 which is communicated to the closing solenoid valve 57 normally maintained in open position. Said valve 57 is communicated to the valve plunger 31 via line 36 to maintain plunger 31 in the operating or retracted position. Momentary release of the pressure from valve 57 which communicates with body 26, will allow spring pressure to adjust plunger 31 to its non-flow position.

Commencement of fluid flow from the flow line 18 into the main control valve 21 is triggered by way of third valve 48 which is normally in a closed position. Said valve embodies a transceiver 38 which is calibrated to receive a transmitted signal from the shore base station 39. In response to said signal, said valve will be adjusted to the open position and timer 48*a* set into motion, thereby triggering opening of the main flow valve 21 to fluid flow.

It is understood that although modifications and variations of the invention can be made without departing from the spirit and scope thereof, only such limitations should be imposed as are indicated in the appended claims.

I claim:

1. A combination with a subterranean well for producing a pressurized fluid stream, which well includes a flow line for conducting said fluid stream to the surface, a main valve in said flow line having a main valve actuator associated therewith for adjusting said main valve to opened and closed positions, of a flow control system for adjusting said main valve to open position subsequent to closing thereof under an emergency or elective condition, including:

means for establishing initial communication between said main valve actuator and said flow line in response to a remotely transmitted signal, whereby to provisionally open said main valve to fluid flow, means for maintaining said initial communication during a predetermined time interval to allow fluid pressure in said flow line to stabilize to a level within a desired operating flow pressure range, and pressure sensing means communicated with said main valve actuator to disestablish communication between said main valve actuator and said flow line subsequent to lapse of said predetermined time interval, in the event the pressure in said flow line fails to stabilize within the desired operating flow pressure range.

2. In the combination as defined in claim 1, wherein said means for establishing said initial communication includes a second valve means having a valve body including an inlet port communicated with said flow line, and an outlet port communicated with said main valve actuator, a transfer member operable in said valve body, being adjustable between an advanced position to a retracted position in response to a fluid pressure exerted thereagainst whereby to establish fluid communication between said inlet and outlet ports.

3. In the combination as defined in claim 2, wherein said means for establishing initial communication between said main valve actuator and said flow line includes a timer means operable to effectuate said timed interval.

4. In the combination as defined in claim 3, wherein said means for establishing initial communication includes a third valve means having an inlet communicated with said flow line, and having an outlet communicated with said valve body to operably displace said transfer member to the retracted position when said third valve means is adjusted to open position, and said timer means is associated with said third valve means to adjust the latter to closed position after lapse of said timed interval.

5. In the combination as defined in claim 1, including a high/low pressure sensing and fluid cutoff means communicating said second valve body with said flow line, to displace said transfer member to the advanced position when said flow line pressure is sensed to be outside of the desired operating pressure range after lapse of said timed interval.

6. In the combination as defined in claim 2, wherein said second valve transfer member is operable between said advanced and retracted positions in response to manual manipulation thereof.

7. In the combination as defined in claim 5, wherein said third valve includes a third actuating means adapted to adjust said third valve to the open position in response to a remote signal.

8. In the combination as defined in claim 7, including a signal receiver adapted to receive a remotely transmitted radio signal.

9. In the combination as defined in claim 7, including means to override said timer means during the predetermined timed interval.

10. A for remotely regulating a pressurized flow of production fluid from an offshore well which includes a flow line communicated with a subterranean reservoir holding said pressurized production fluid, a main flow control valve in said flow line, and an actuator operably engaging said main flow control valve for adjusting the same between open and closed positions, which method includes the step of:

A. providing a remotely actuated main flow control valve system, comprising a first pneumatic circuit means for communicating said main valve actuator with said flow line, and pressure sensing means in said first pneumatic circuit means for maintaining flow line pressure against said main valve actuator only within a predetermined range of operating pressures, a second pneumatic circuit means for communicating said main valve actuator with said flow line, and a flow initiating valve in said second pneumatic circuit means being operable to open position in response to a remotely transmitted radio signal, and being operable to closed position by a timer mechanism, whereby to discontinue pressure through said second circuit means to said main valve actuator after a preset time interval, and B. transmitting a radio signal to said flow initiating valve for opening said valve.

11. A method as defined in claim 10, wherein said predetermined preset time interval does not exceed about 2 seconds.

* * * * *